US008857509B2

(12) United States Patent
Yin

(10) Patent No.: US 8,857,509 B2
(45) Date of Patent: Oct. 14, 2014

(54) SUBTERRANEAN WELL TOOLS HAVING NONMETALLIC DRAG BLOCK SLEEVES

(75) Inventor: Chieh Yin, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 327 days.

(21) Appl. No.: 13/359,229

(22) Filed: Jan. 26, 2012

(65) Prior Publication Data

US 2013/0192819 A1 Aug. 1, 2013

(51) Int. Cl.
*E21B 23/06* (2006.01)
*E21B 33/129* (2006.01)

(52) U.S. Cl.
USPC ..... 166/118; 166/138

(58) Field of Classification Search
CPC ..... E21B 23/01; E21B 23/06; E21B 33/1291; E21B 33/12955
USPC ..... 166/118, 138, 386, 387
See application file for complete search history.

(56) References Cited

U.S. PATENT DOCUMENTS

| | | | | | |
|---|---|---|---|---|---|
| 1,723,600 | A | * | 8/1929 | Cant | 166/138 |
| 2,061,289 | A | * | 11/1936 | Phipps | 417/189 |
| 2,627,316 | A | * | 2/1953 | Baker | 166/140 |
| 2,627,317 | A | * | 2/1953 | Baker | 166/128 |
| 2,776,012 | A | * | 1/1957 | Baker | 166/123 |
| 3,266,576 | A | * | 8/1966 | Chenoweth | 166/121 |
| 3,324,952 | A | * | 6/1967 | Berryman | 166/240 |
| 3,399,729 | A | * | 9/1968 | McGill | 166/120 |
| 3,422,898 | A | | 1/1969 | Conrad | |
| 4,590,995 | A | | 5/1986 | Evans | |
| 4,627,491 | A | * | 12/1986 | Zunkel | 166/126 |
| 2003/0221833 | A1 | * | 12/2003 | Gentry et al. | 166/305.1 |

* cited by examiner

*Primary Examiner* — Kenneth L Thompson
(74) *Attorney, Agent, or Firm* — John W. Wustenberg; Booth Albanesi Schroeder LLC

(57) ABSTRACT

Disclosed is a drag block assembly for use on a downhole tool for location in a cased wellbore. The tool has a hollow mandrel for suspension from a tubing string. The drag block, slips and packing elements mounted on the mandrel are moveable between the run and set positions by movement of the drag block, while engaging a lug on the mandrel. The drag block assembly comprises longitudinally spaced rings comprising resilient material connected together by longitudinally extending members.

19 Claims, 4 Drawing Sheets

SUBTERRANEAN WELL TOOLS HAVING NONMETALLIC DRAG BLOCK SLEEVES

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

TECHNICAL FIELD

This invention relates to apparatus for completing and producing hydrocarbons from wells, and, in particular, to improved well tools that are supported in the wellbore at a subterranean location. The apparatus of the present invention are applicable to packers, plugs, liner hangers, and like tools of the type utilizing a gripping means to secure the tool in position in the wellbore.

BACKGROUND OF THE INVENTION

In the completion and the production of hydrocarbons from wells, it is frequently necessary to isolate a portion of the well using a well tool, such as a packer, plug, tubing hanger and the like, supported in the wellbore at a subterranean location. These tools are lowered into the well in a retracted state called the "run position" and in a process called "setting", the gripping means and packing means are radially expanded to a "set position" wherein the slips means and packing means engage the wellbore. A variety of types of gripping means are well known in the art and, in the illustrated embodiment, a slip means with wedge-shaped slip elements is described. Typically, packing means have resilient annular members mounted on the tool to move axially to pack off or seal the annulus around the tool. In the disclosed embodiment, the packing means comprise one or more resilient annular packing elements which, depending on the use environment, may also comprise back up and/or anti-extrusion rings. When these packing elements are axially compressed, they expand radially from the mandrel into contact with the wellbore. To hold these tools in place in the wellbore against movement, slip means typically are mounted on the tool. These slip means, like the packing means, expand radially to grip the wellbore when forced to compress axially.

Axially directed forces are used to axially compress the packing elements and slip assemblies. Such forces are typically generated by moving the tubing string; initiating an explosive charge; or applying pressure to the tool. Examples of tools that are set by manipulating the tubing string include weight down and tension packers. A weight down packer is one in which force generated by the weight of the tubing string above the tool is used to set (expand) the packing and slip element and to hold the tool in set condition. In a tension packer, the tubing string is placed in tension and that tension force is used to set and hold the tool in the set condition.

Weight down and tension packers typically comprise a hollow tubular mandrel which is connected to the tubing string. Mounted on the mandrel are the axially compressible packing elements adjacent to the slip assembly. An annular tool element called a "drag block assembly" is located on the mandrel, adjacent the slip assembly on the opposite side from the packing elements. In weight down tools, the drag block is located below the slip means and, in the tension packer, the drag block is located above the slip mean.

Certain terminology may be used in the following description for convenience only and is not limiting. For instance, the words "inwardly" and "outwardly" are directions toward and away from, respectively, the geometric center of a referenced object. Note that as used herein, "below", "down", "downward", or "downhole" refers to the direction in or along the wellbore away from the wellhead whether the wellbore's orientation is horizontal, toward the surface or away from the surface. The terms "above," "up," "upward" or "uphole" indicates the direction in and along the wellbore toward the wellhead, whether the wellbore's orientation is horizontal, toward the surface, or away from the surface. As used herein, the term "J-slot tool" refers to a tool having a sleeve receptacle with a fitted, male element that has pins that fit into J-shaped slots on the sleeve. The J-shaped slots have short and long sides or legs. The short sides of the j-slots provide a shoulder for limiting relative movement between the pin and the sleeve. When the male element is moved up or down, depending on the orientation of the slot, and turned relative to the sleeve, the pins slide in the slot towards the long side of the J, which is open ended or long. The pins are released to move the length of the long side, thus releasing the sleeve for movement. The releasing procedure is called "unjaying the tool." In some embodiments, the location of the pin and slot is reversed with the pin located on the sleeve. As used herein, the term "synthetic material" refers to materials that are not of natural origin and that are prepared or made artificially, using synthesis by combining separate elements or by modifying elements.

Drag block assemblies typically frictionally engage the wellbore. Drag block assemblies are mounted to slide axially on the mandrel. Movement of drag block on the mandrel is commonly limited by a pin in a J-slot. By axially moving and rotating the tubing string counter clockwise, the pin can be moved from the short leg of the J-slot to the long leg where axially moving the tubing string causes the drag block assembly to set the slip assembly and packing elements.

Conventional prior art packers utilize complicated, expensive drag block assemblies made from heavy metallic with metallic springs that engage the wellbore. An example of a prior art weight down packer of this type is illustrated in U.S. Pat. No. 4,590,995, which is incorporated by reference herein for all purposes. Examples of commercial versions of these tools are marketed by Halliburton as Champ® V Packer and Pin Point Injection (PPI) Packer. A conventional tension packer is illustrated in U.S. Pat. No. 3,422,898, which is incorporated by reference herein for all purposes.

Thus, there are needs for improved methods and apparatus for setting well tools, including providing a simple, cost-effective, improved drag block assembly that can be used with packers and other well tools.

SUMMARY

The present invention provides improved methods and apparatus for setting tools in the wellbore at downhole locations, using drag blocks molded from synthetic elastomeric materials. These drag blocks of the present invention are simple and inexpensive to construct and relatively lightweight, thus reducing tubing string weight.

Other and further objects, features and advantages of the present invention will be readily apparent to those skilled in the art upon a reading of the description of preferred embodiments which follows when taken in conjunction with the accompanying drawings, in which:

DETAILED DESCRIPTION OF THE INVENTION

Figure 1:
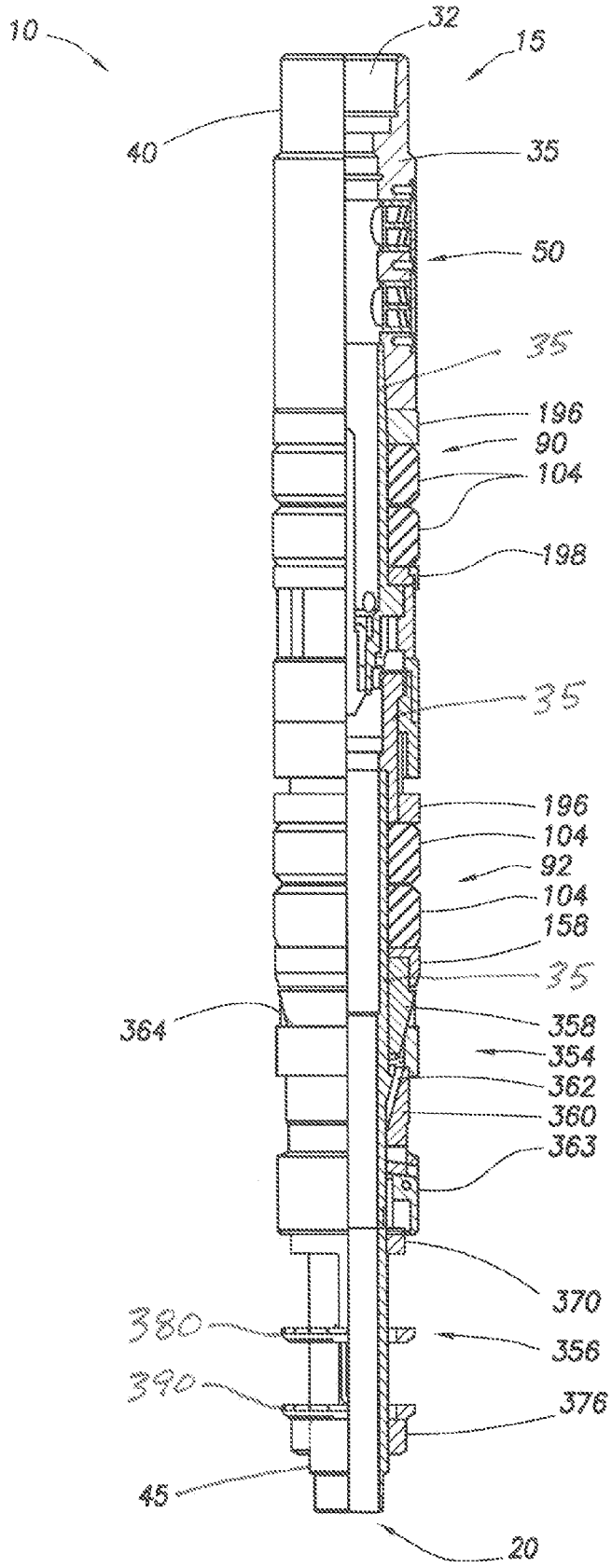
FIG. 1 is an elevation view partially in section illustrating a weight down packer embodying principles of the present invention.
Figure 2:
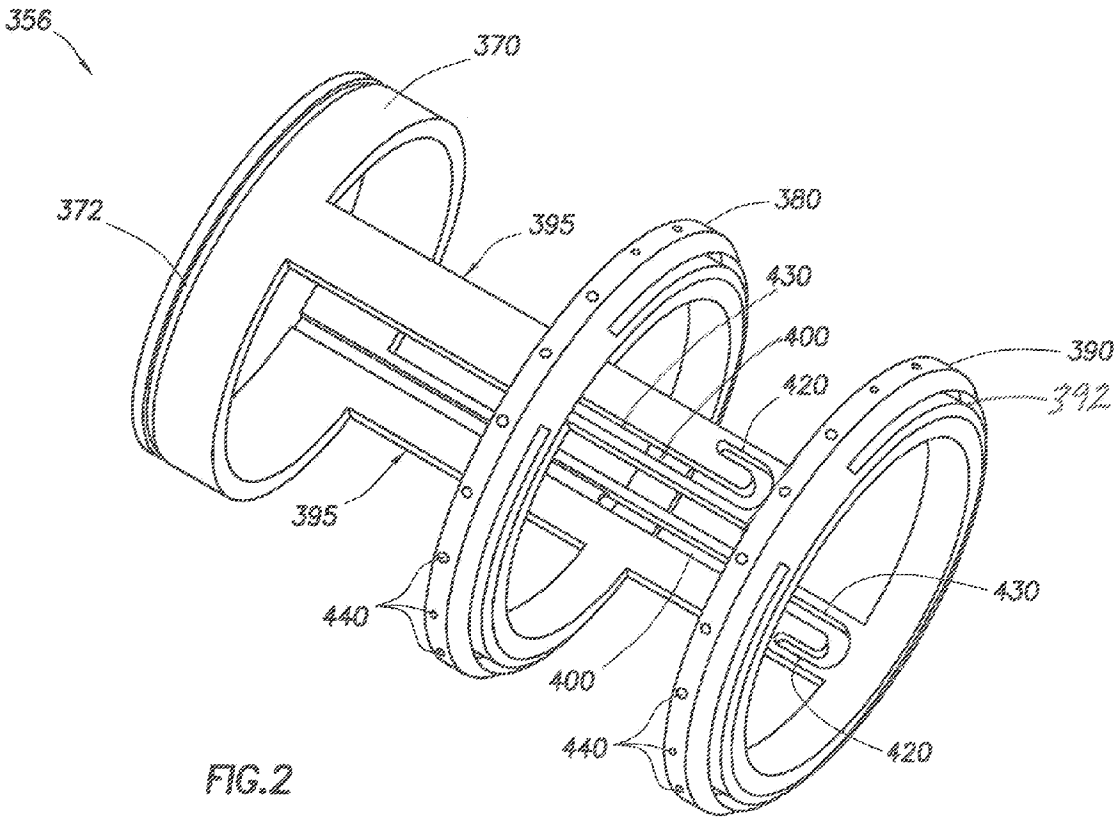
FIG. 2 is a perspective view of one embodiment of the drag block configuration of the present invention.

The present invention provides improved methods and apparatus for setting packers and other well tools in wellbores at subterranean location. One embodiment of the invention will be described by reference to the drawings in which reference characters are used to indicate like or corresponding parts throughout the several figures. Referring now to the drawings and in particular to FIG. 1, there is illustrated partially in section one embodiment of a weight down packer apparatus 10 configured for use as a straddle packer or pinpoint injection packer. FIG. 1 illustrates packer apparatus 10 in a first or run-in position prior to it being set in the wellbore. Packer apparatus 10 is adapted to be connected in a tubing string in a cased wellbore (not shown). As will be described, the packer has two sets of spaced packing means that, when set, isolate a length of the wellbore for treatment. It should be understood that the packer apparatus could be configured with one set of packing means and used as a conventional packer.

Packer apparatus 10 may have an upper end 15 which has internal threads thereon adapted to be suspended from a tubing string (not shown) which extends to the well head. Packer apparatus 10 further includes a lower end 20 having threads thereon for connecting with tubing string (not shown) or other apparatus located below packer apparatus 10. Thus, packer apparatus 10 is adapted to be connected to and made up as part of a tubing string 11. The tubing strings above and below packer apparatus 10 may be production tubing or any other known work or pipe string and may include any kind of equipment and/or tool utilized in the course of treating and preparing wells for production. Packer apparatus 10 defines a central flow passage 32 for the communication of fluids through packer apparatus 10 and tubing strings above and below the packer.

Packer apparatus 10 includes a packer mandrel 35 with an upper end 40 and a lower end 45. In this embodiment, the packer mandrel 35 is a multi-part mandrel; however, a single piece mandrel could be used. Lower end 45 comprises the lower end of the packer apparatus and includes the lower threads. Upper end 40 may be threaded to a hydraulic hold-down assembly 50 which has threads therein adapted to be connected to the tubing string, thereby adapting packer mandrel 35 to be connected in tubing string. The operation and construction of the hydraulic hold-down assembly is well known in the industry.

Packer apparatus 10 further includes an upper radially expandable seal assembly 90 disposed about packer mandrel 35. A lower radially expandable seal assembly 92 is disposed about the packer mandrel 35 at a position axially below upper seal assembly 90. As shown in FIG. 1, axially spaced seal assemblies 90 and 92 are closely received about outer packer surface. Seal assemblies 90 and 92 are spaced of isolate a portion of the wellbore for treatment. Although not shown or described, a valve or injection port may be located between the seal assemblies 90 and 92 for flowing fluids between the isolated wellbore portion and mandrel interior. Seal assemblies 90 and 92 may comprise one or more annular sealing elements 104. Sealing elements 104 are preferably formed from an elastomeric material, such as, but not limited to, NBR, FKM, VITON®, or the like. However, one skilled in the art will recognize that, depending on the temperatures and pressures to be experienced, other materials may be used without departing from the scope and spirit of the present invention.

Seal assemblies 90 and 92 may further include anti-extrusion rings (not shown). Packer apparatus 10 further includes first, or upper and second, or lower annular shaped pusher shoes 196 and 198, respectively, disposed on the mandrel, abutting the outer most sealing elements of the seal assemblies 90 and 92.

Lower pusher shoe 198 on seal assembly 92 is threaded at its lower end to slip means in the form of a slip assembly 354. Slip assembly 354 is, in turn, connected at its lower end to a drag block assembly 356. Slip assembly 354 is of a type known in the art. Thus, slip assembly 354 may include a slip wedge 358 disposed about packer mandrel 35 and a plurality of slips 360 disposed on the mandrel adjacent slip wedge 358.

A lower end 362 of slip wedge 358 engages a generally upwardly facing shoulder 364 on mandrel 35. Shoulder 364 limits downward movement of the wedge on the mandrel when packer apparatus 10 is in the run in position. Shoulder 364 preferably extends around the entire circumference of packer mandrel 35. Slip wedge 358, which is slidable relative to mandrel 35 may have slots therein to allow wedge 358 to slide relative to the packer mandrel. Such a configuration and the operation thereof are well known in the art.

A split ring collar 363 connects drag block assembly 356 to the lower end of the slip assembly 354. The details of the drag block assembly 356 are illustrated in FIGS. 2-5. In the preferred embodiment, drag block assembly 356 includes three axially spaced annular rings, i.e., upper ring 370, center ring 380 and lower ring 390. Three rings were selected for this embodiment; however, it is envisioned that more or less rings could be included. A pair of longitudinally extending, side members 395 connect the rings together in a parallel spaced relationship. Again, more or less side members could be included, as desired. The side members could be formed as a continuous or slotted cylinder, extending between two or more of the rings.

Drag block assembly 356 is substantially formed from a synthetic material. In the preferred form drag block assembly 356 is integrally formed by molding from an elastomeric materials, such as, Nitrile Butadiene Rubber (NBR), Hydrogenated Acrylonitrile-butadiene Rubber (HNBR), Florocarbon Rubber (FKM), Tetrafluroethylene-Propylene (AFLAS) and any elastomeric materials that could withstand a well environment. The term "elastomeric material" is used herein, to refer to material that has a substantial resilient property. The term "substantially non metallic material" is used to describe a drag block which may comprise metallic wear or structural members but is not primarily formed of metallic material.

J-slots 400 with short leg 420 and long leg 430 are preferably formed in the inside surface of side members 395. A pair of radially outwardly extending lugs 376 is defined on the packer mandrel 35. As is known in the art, lugs 376 are preferably disposed 180 degrees apart and rest in short legs 420 of J-slots 400 when packer apparatus 10 is in the run position. The legs of the J-slot 400 need not extend through the side members 395, but need only be deep enough to allow the lugs 376 formed on the mandrel 35 to travel up and down therein. As shown, portions or all of the slots 400 can extend completely through the side members 395.

Figure 3:
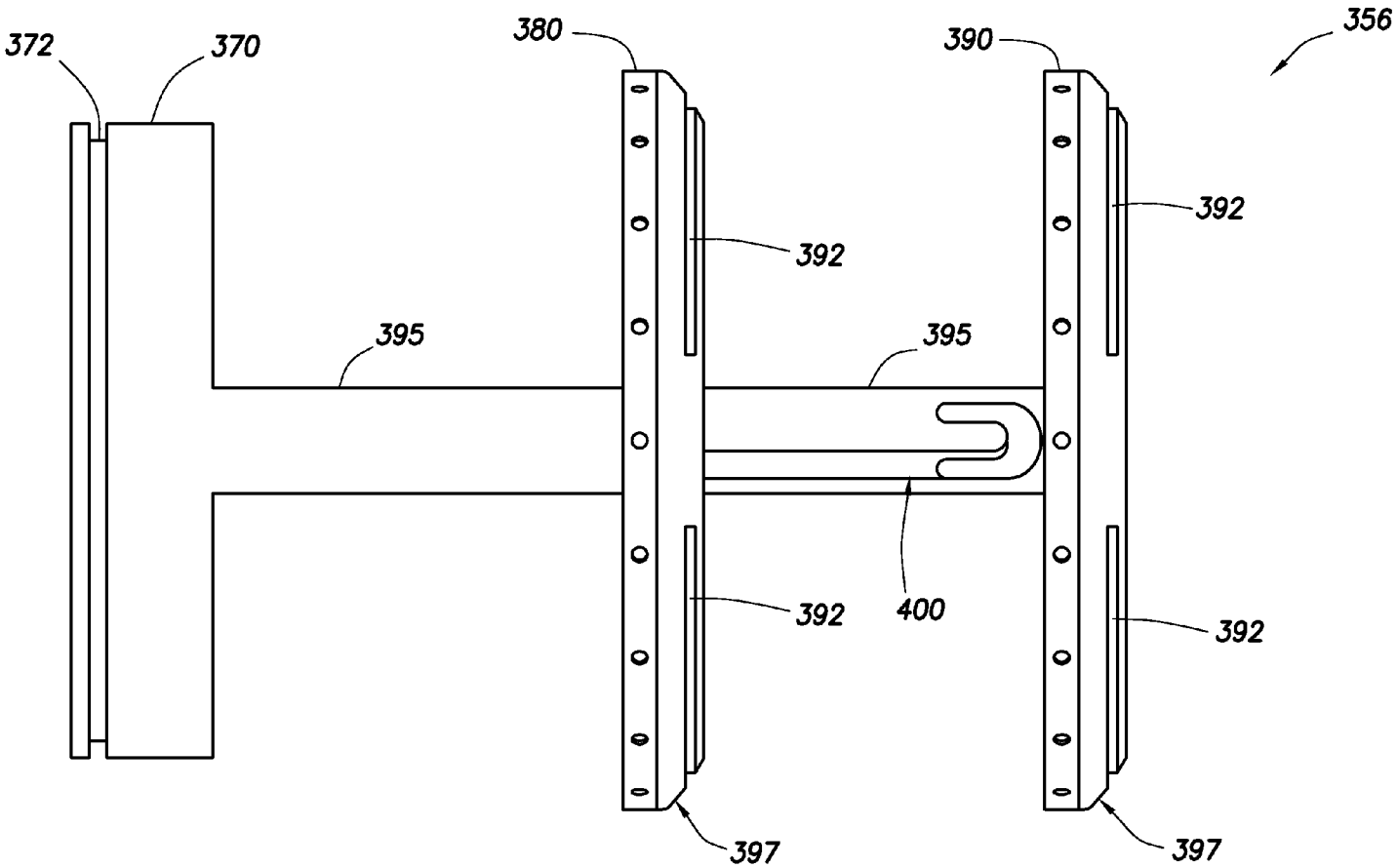
FIG. 3 is a side elevation view of the drag block configuration of FIG. 2.
Figure 4:
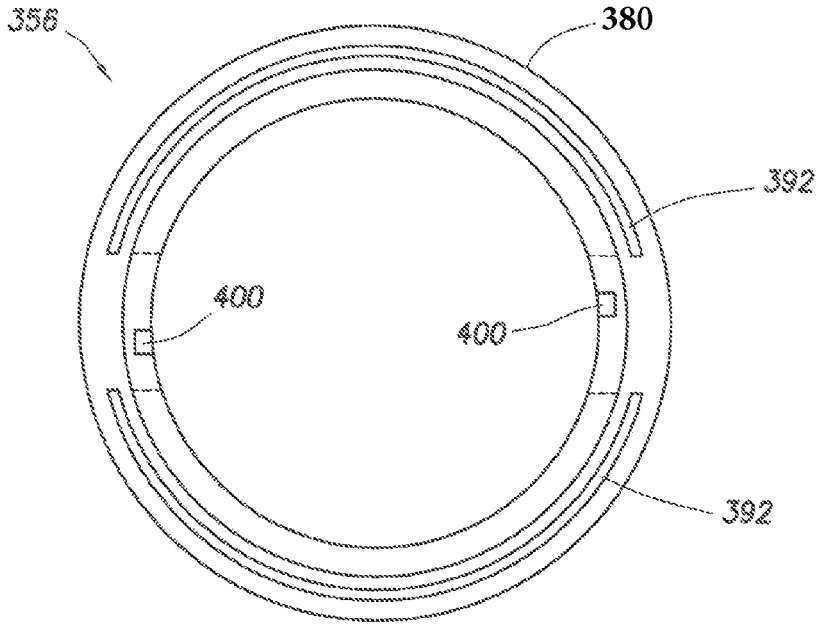
FIG. 4 is a cross-sectional view of the drag block configuration of FIG. 3 taken at central ring 380 and indicating the positioning of side members 95.
Figure 5:
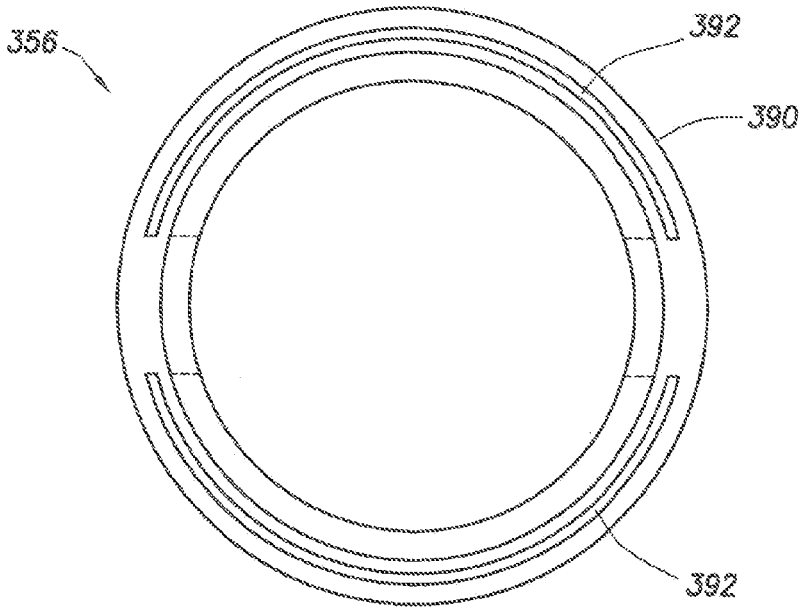
FIG. 5 is a cross-sectional view of the drag block configuration of FIG. 3 taken at lower ring 390 and the positioning of side members 95.

Rings 380 and 390 are sized to fit around and slide axially on the exterior of mandrel 35. As illustrated in FIG. 3, rings 380 and 390 have downward facing tapered profiles 397. The taper is in the form of frusto conical surfaces at the downward facing edge. Flow passages 392 are formed in rings 380 and 390 to permit fluids in the well to bypass the rings. Flow passages 392 extend axially through the rings. The maximum diameter of the outer surface of the rings 380 and 390 is selected to form an interference fit to frictionally engage or drag along the inner diameter of the wellbore. The diameter of the rings 380 and 390 is selected so that a drag force is created sufficient to axially move the drag block assembly when the lugs 376 are located in the long leg 430 of the J-slot 400. Preferably, the interference fit is small enough as to minimize wear on the rings from contact with the wellbore. To provide additional drag force and to limit damage to rings 380 and 390, wear members 440 in the form of buttons or inserts are mounted on or in the exterior surface of rings 380 and 390. The wear members can be formed from tough wear resistant materials, such as composite materials (hard rubber, resins and the like), metallic materials (steel, carbide and the like), and ceramic materials. Upper ring 370, like rings 380 and 390, has an interior that is sized to fit around and slide axially on the exterior of mandrel 35. In this embodiment, the exterior surface of upper ring 370 is cylindrical and has a smaller maximum outer diameter than the other rings. Ring 370 has an annular groove 372 for use in coupling the drag block assembly to the slips via split collar 363.

The operation of the illustrated pin point injection packer apparatus 10 is as follows. Packer apparatus 10 is assembled and lowered on a tubing string into a cased wellbore in the run position illustrated in FIG. 1. The drag block rings 380 and 390 engage the inner surface of casing as packer apparatus 10 is lowered into the wellbore. Once packer apparatus 10 has reached the desired location in wellbore, it is necessary to move packer apparatus 10 to a set position. The tubing string is raised upwardly, which causes the hydraulic hold-down assembly 50 and packer mandrel 35 to be pulled upward.

Friction forces generated by contact between drag block rings 380 and 390 and the well casing will hold drag block assembly 354 in place while packer mandrel 35 is moved upward. Packer mandrel 35, initially positioned in shower legs 420, is moved upward and rotated counter clockwise so that lugs 376 on mandrel 35 are positioned above long legs 430 of J-slots 400. The upward pull on the tubing string is then released and packer mandrel 35 is allowed to move downward.

As packer mandrel 35 moves downward, drag block assembly 356 moves slips 360 upward onto the wedge 358 to expand the slips radially outwardly. The slips will move radially outward into contact with the casing. The slips will move into the set position with the slips engaging and grab the casing. In this set position, the slips will limit or restrict movement of the tool.

With the slips engaged with the casing, further downward movement of the packer mandrel 35 will cause lower pusher shoe 198 to engage and axially compress seal assemblies 90 and 92, thus expanding seal assembly 92 radially outward into the set position. In the set position the seal assemblies 90 and 92 seals or restricts flow through the annulus formed between the packer and the wellbore casing. Ideally, in this embodiment, when the packer apparatus 10 is in the set position, seal assemblies 90 and 92 sealingly engages casing and operate to maintain a seal at wellbore temperatures and pressures. To engage the hydraulic hold down assembly, a positive pressure differential is applied between the interior of the tubing string and the annulus around the tubing. To perform a pin point injection of well treating fluids into the isolated portion of the wellbore, fluids are pumped down the tubing string and exit the mandrel through a port, nozzle, valve or the like located in the mandrel between the seal assemblies 90 and 92.

If it is desired to remove the packer apparatus from the wellbore or to set the packer apparatus at a different location, an upward pull is applied so that packer mandrel 35 will begin to move upwardly. Shoulder 364 on mandrel 35 will engage the lower end 362 of slip wedge 358 and will pull wedge 358 up to allow slips 360 to retract radially inwardly and release the grab on the casing. Likewise, an upward pull on the packer mandrel 35 will allow the seal assembly 92 to retract radially from the casing wall. When lugs 376 reach the top of J-slots 400, clockwise rotation will move the lugs 376 to a position above short legs 420 of J-slots 400. Packer mandrel 35 can be set back down and lugs 376 will rest in short legs 420 of J-slots 400. Packer apparatus 10 will be once again in the run position as shown in FIG. 1.

Packer apparatus 10 of the present invention can be set numerous times in a wellbore and will successfully maintain sealing engagement with the casing each time it is set in a wellbore at the extreme temperatures and pressures contemplated.

In the tension packer embodiment (not illustrated), the orientation of the slips, packing and drag block assembly is reversed. In the tension packer embodiment, the drag block is above the slips and the seal assembly is position below the slip wedge. To install the tension packer embodiment, the packer is positioned in the wellbore. Next, the tubing string is lifted and rotated counter clockwise to move the lugs into the long legs of the J-Slots on the drag block assembly. The tubing sting and mandrel are then lifted and placed in tension, to lift the slips against the slip wedge and compress the packing assembly. To remove the tension packer, the process is reversed.

What is claimed is:

1. A tool for use in a cased wellbore, the tool comprising:

a hollow mandrel adapted for suspension from a tubing string in a wellbore at a subterranean location;

means located on the mandrel for movement into and out of a radially expanded position engaging the wellbore sufficiently to limit movement of the tool in the wellbore; and a drag block located on the mandrel operably associated with the wellbore engaging means, the drag block comprising a plurality of longitudinally spaced drag rings, the internal surfaces of the rings fitting around the mandrel in sliding relationship and the outer surface of the rings being of a size to frictionally engage the wellbore casing, a longitudinally extending member connected to and extending between the rings, the longitudinally extending member maintaining the drag rings in their longitudinally spaced positions, a J-slot defined in the longitudinally extending member.

2. The tool of claim 1, additionally comprising packing means on the mandrel for movement into and out of a radially expanded position, engaging the wellbore sufficiently to restrict flow through the wellbore past the exterior of the mandrel.

3. The tool of claim 1, wherein the plurality of spaced rings comprises resilient material.

4. The tool of claim 1, wherein the plurality of spaced rings are substantially comprised of synthetic nonmetallic material.

5. The tool of claim 1, wherein the drag rings have axially extending fluid flow paths through the drag rings.

6. The tool of claim 1, wherein the J-slot is formed on an interior surface of a longitudinally extending member.

7. The tool of claim 1, wherein the plurality of drag rings each has an outer diameter that is larger than the internal diameter of the wellbore casing.

8. The tool of claim 1, wherein the plurality of spaced rings comprises two rings.

9. The tool of claim 1, wherein the drag rings are substantially comprised of material selected from the group consisting of: Nitrile Butadiene Rubber, Hydrogenated Acrylonitrile-butadiene Rubber, Fluorocarbon Rubber, and Tetrafluroethylene-Propylene.

10. The tool of claim 2, wherein the tool is a weight down set well tool.

11. The tool of claim 2, wherein the tool is a tension set well tool.

12. The tool of claim 1, wherein metallic wear members are located in the outer surface of the drag rings.

13. The tool of claim 12, wherein the wear members comprise ceramic material.

14. The tool of claim 12, wherein the wear members comprise metallic material.

15. The tool of claim 1, wherein the drag block material is nonmetallic.

16. The tool of claim 1, wherein drag block material is synthetic, nonmetallic material.

17. The tool of claim 1, additionally comprising means for operably associating the drag block with the means located on the mandrel for movement into and out of a radially expanded position engaging the wellbore.

18. The tool of claim 1, wherein the operably associating means comprises an additional ring connected to the longitudinally extending member.

19. The tool of claim 18, wherein the additional ring has an internal surface that fits around the mandrel and an outer surface that is smaller in diameter than the diameter of the outer surface of said plurality of drag rings.

* * * * *